United States Patent [19]

Brzezinski

[11] Patent Number: 4,530,563

[45] Date of Patent: Jul. 23, 1985

[54] METHOD FOR MAKING A SOLDER JOINT AND THE SOLDER JOINT MADE THEREBY

[75] Inventor: Dorothy S. Brzezinski, Crystal Lake, Ill.

[73] Assignee: Coilcraft, Inc., Cary, Ill.

[21] Appl. No.: 431,850

[22] Filed: Sep. 30, 1982

[51] Int. Cl.[3] ..... H01R 5/04

[52] U.S. Cl. ..... 339/275 B; 228/135; 228/180.1

[58] Field of Search ..... 228/57, 180 R, 179, 228/135, 136, 138, 139, 245, 246, 37; 29/605; 339/275 A, 275 B; 336/192

[56] References Cited

U.S. PATENT DOCUMENTS

| | | | |
|---|---|---|---|
| 2,884,612 | 4/1959 | Bang | 228/259 X |
| 3,054,027 | 9/1962 | Barrick et al. | 336/192 |
| 3,548,360 | 12/1970 | Schlueter | 339/275 B X |
| 3,609,616 | 9/1971 | Dumeige | 336/192 |
| 3,874,068 | 4/1975 | Cook | 228/37 X |
| 4,174,563 | 11/1979 | Simpson | 228/245 X |

*Primary Examiner*—Kenneth J. Ramsey
*Assistant Examiner*—M. Jordan
*Attorney, Agent, or Firm*—Thomas R. Vigil

[57] ABSTRACT

The method is utilized for forming a solder joint (51–53) between a wire end portion (21–30) of a coil mounted on a hub (16) and an end tab (73) of a male or female connector (31–36) that can be mounted on a support (41–46) fixed to the hub (16). The method includes the steps of: placing at least one wire end portion (24) adjacent an end tab (73); placing an encircling ring (80; 180) of material about the end tab (73) and the at least one wire end portion (24), said ring of encircling material being sized to fit snugly about the end tab (73) and the at least one wire end portion (24) so that they are juxtaposed to each other and so that the resiliency of the at least one wire end portion (24) urging it away from the end tab (73) is sufficient to frictionally hold the ring (80; 180) of encircling material around the end tab (73) and the at least one wire end portion (24); inverting and dipping the assembly (78) of the end tab (73), the at least one wire end portion (24) and the ring (80; 180) of encircling material into a solder bath; and removing the assembly (53) from the solder bath and allowing it to cool and harden. The solder joint (53) includes at least one wire end portion (24) juxtaposed to a connector end tab (73) and having a ring (80; 180) of encircling material holding them together and adhered solder (86) in and around the at least one wire end portion (24), the end tab (73) and the ring (80; 180) of encircling material.

16 Claims, 8 Drawing Figures

METHOD FOR MAKING A SOLDER JOINT AND THE SOLDER JOINT MADE THEREBY

BACKGROUND OF THE INVENTION

1. Field of the Invention

The present invention relates to solder joints where one or more conductor ends are brought together and soldered. More specifically, the present invention relates to an improved method for making a solder joint and the solder joint made thereby where it is desired to create a solder joint between a wire end portion extending from a coil mounted on a hub and an end tab of a male or female connector mounted on a support fixed to the hub and wherein there is a multiple of such connections to be made in a multi-coil assembly.

2. Description of the Prior Art

Heretofore in a multi-coil assembly where wire end portions from the coils are connected to respective male or female connectors mounted on cantilever support arms fixed to and extending from the hub on which the coils are mounted it has been customary to bring the wire end portions out to an upstanding rear end tab of the connector and twist the wire end portion around the end tab. After all the wire end portions are so twisted around end tabs, the end tabs are dipped in hot solder to solder the connection of each twisted wire end portion to each respective end tab.

In the construction described above some problems have been incurred in that pulling a wire end portion adjacent a cantilever support causes twisting or bending of the cantilever arm support such that the connectors are not in alignment with each other and this causes difficulty in coupling a terminal block with female connectors onto male connectors supported on the cantilever arm supports.

Also, a worker in twisting a wire end portion around an end tab does not always provide a good metal to metal connection between the twisted wire end portion and the end tab. Additionally, sometimes the twisted wire end portion will spring off the end tab and no connection is made when the end tabs are dipped into solder.

Furthermore, when a plurality of coils are mounted on the hub with a plurality of cantilever support arms, each with a male connector mounted thereon and the connector having an end tab extending outwardly from the connector and the support arm, problems have been incurred in dipping the end tabs with wire end portion(s) twisted therearound. In this respect, thick conductors are hard to twist around an end tab and the twisted end portion thereof around an end tab is bulky. Also where several wire end portions are twisted around an end tab, the resulting assembly is bulky. Such bulky assemblies take up a significant amount of space. As a result, there is often times insufficient spacing between adjacent end tabwire end portion(s) assemblies to meet electrical and mechanical specifications. Additionally, when these assemblies are dipped in a hot solder bath, bridging of solder between adjacent assemblies often occurs short circuiting the assemblies which is highly undesirable.

It has heretofore been proposed to provide various sleeves for connecting wire end portions. A common example is the wire joint sold under the trademark "WIRE-NUT".

Also it has been proposed to provide a sleeve with solder therein and to insert two or more wire end portions into the sleeve and heat the same for soldering the wire end portions together. See the Simpson U.S. Pat. No. 4,174,563.

Further it has been proposed to provide terminal pins which are hollow and which extend from a printed circuit board and into which one or more wire end portions can be inserted followed by heating the pin while inserting solder from a coiled wire solder into the opening to the pin. See the Schlueter U.S. Pat. No. 3,548,360.

Still further it has been proposed to provide a sleeve which fits over one or more wire end portions and which is crimped to provide a solid connection between the wire end portions. Some sleeves of this type are provided with an insulating sleeve and some are uninsulated. Examples of such sleeve wire joints are sold under the trademarks "PIGGY" and "STA-KON" by The Thomas & Betts Co. of Elizabeth, N.J.

The method for making a solder joint and the solder joint made thereby of the present invention differ from the previously proposed solder joints by providing for the bringing together of a wire end portion and an end tab of a male connector mounted on a cantilever support arm which is fixed to an end flange of a hub on which the coils of a multi-coil assembly are mounted followed by placing a ring of encircling material around the juxtaposed end tab of a connector and the wire end portion followed by inverting the multi-coil assembly and dipping the encircled end tab and wire end portion assemblies into a solder bath. If desired, prior to soldering, the assemblies can be crimped to ensure a good metal to metal connection between the ring of encircling material and the wire end portion and the end tab. The resulting solder joint assemblies are uniform in size and take up a minimum of space thereby ensuring adequate spacing between solder joint assemblies and avoiding solder bridging between adjacent solder joint assemblies.

SUMMARY OF THE INVENTION

According to the invention there is provided a method for forming a solder joint between a wire end portion of a coil mounted on a hub and an end tab of a male or female connector that can be mounted on a support fixed to the hub, said method including the steps of: placing at least one wire end portion adjacent an end tab; placing an encircling ring of material about the end tab and the at least one wire end portion, said ring of encircling material being sized to fit snugly about the end tab and the at least one wire end portion so that they are juxtaposed to each other and so that the resiliency of the at least one wire end portion urging it away from the end tab is sufficient to frictionally hold the ring of encircling material around the end tab and the at least one wire end portion; inverting and dipping the assembly of the end tab, the at least one wire end portion and the ring of encircling material into a solder bath; and removing the assembly from the solder bath and allowing it to cool and harden.

Further according to the invention there are provided solder joint assemblies in a coil and hub assembly including a hub, a coil mounted on said hub and having wire end portions extending therefrom, a support mounted to and extending from said hub, and a plurality of connectors having end tabs mounted on said support, each solder joint assembly being formed between a corresponding wire end portion and a corresponding end tab of a male or female connector mounted on said support, and each solder joint assembly comprising one wire end portion having insulation all the way to the soldered end of said wire end portion, being juxtaposed to one connector end tab, having a ring of encircling material holding them together, and having a mound of solder surrounding the assembly of the one end portion, the one end tab and said ring of encircling material, said solder also being received within the interstices between the parts of the assembly and being adhered to the parts of the assembly, and no solder bridging the gaps between adjacent solder joint assemblies after the end tabs of said coil and hub assembly have been dipped in a solder bath and then removed therefrom.

DESCRIPTION OF THE PREFERRED EMBODIMENT

Figure 1:
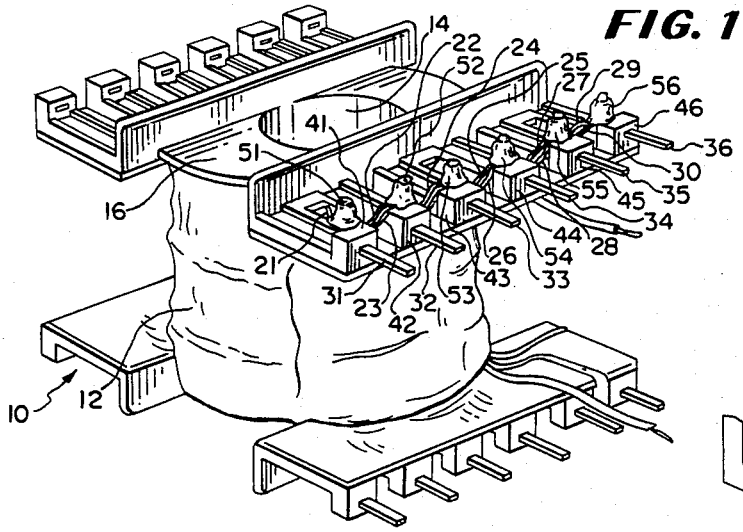
FIG. 1 is a perspective view of a multi-coil assembly mounted on a hub or core and having solder joints of wire end portions soldered to respective end tabs of male connectors mounted on supports fixed to and extending from the hub.

Referring now to FIG. 1, there is illustrated therein a multi-coil assembly 10 wherein several coils (hidden from view) beneath a layer of insulating wrapping 12 are mounted on a hub 14 having end flanges 16 and have end portions 21–30 extending from the wrapping 12 to male connectors 31–36 mounted on cantilever supports 41–46 which are integral with and extend outwardly from one end flange 16. More specifically the end portions 21–30 extend to end tabs (hidden from view) which extend upwardly from the rear end of each male connector 31–36. The end portions 21–30 are soldered in solder joints 51–56 to respective ones of the tabs of the male connectors 31–36.

Figure 2:
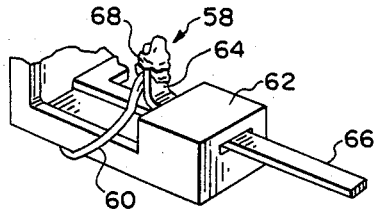
FIG. 2 PRIOR ART
FIG. 2 is a perspective view of a prior art solder joint.

An example of a prior art solder joint 58 is shown in FIG. 2 where a wire end portion 60 extends about a cantilever support 62 and is twisted about an end tab 64 of a male connector 66 mounted on the support 62. In forming this solder joint 58, the wire end portion 60 is pulled against the cantilever support 62 when the wire end portion 60 is twisted around the end tab 64. This places stress on the stiff but deflectable cantilever support 62 and may move the male connector 66 out of its desired position and alignment relative to adjacent male connectors. Also, sometimes the twisted coiled end 68 of the wire end portion 60 does not make good, firm or secure contact with the end tab 64 or slips off the end tab 64.

To minimize, if not altogether eliminate, these problems, the present invention provides a method for making solder joints 51–56 and the solder joints 51–56 made practicing the method. Since all the solder joints 51–56 are substantially identical, only solder joint 53 will now be described in detail with reference to FIGS. 3–7.

Figure 3:
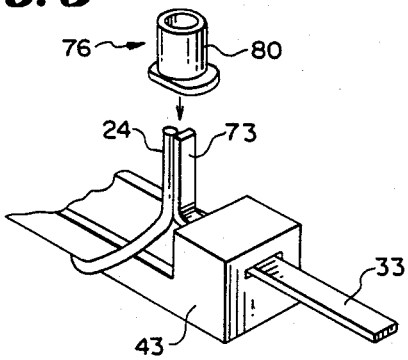
FIG. 3 is an exploded perspective view of a retaining sleeve about to be placed over a wire end portion juxtaposed to an upstanding end tab.
Figure 4:
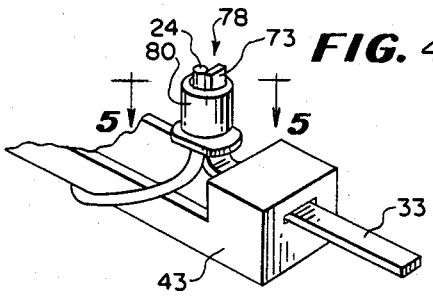
FIG. 4 is a perspective view similar to the view shown in FIG. 3 and shows the resulting assembly of the retaining sleeve received over the wire end portion and the end tab.

Referring now to FIG. 3, in accordance with the teachings of the present invention, a wire end portion 24 is placed against or juxtaposed to an end tab 73 of the male connector 33. Then a ring of encircling material, in this case an unpunched metal eyelet 76 which is often used like a rivet and which is referred to hereinafter as an eyelet or rivet 76, is brought down over the wire end portion 24 and the end tab 73 to form the assembly 78 shown in FIG. 4.

Figure 5:
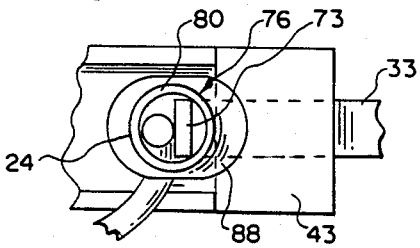
FIG. 5 is a top view of the assembly shown in FIG. 4 and is taken along line 5—5 of FIG. 4.

Preferably and as shown in FIG. 5, the sleeve 80 of the eyelet or rivet 76 fits snugly over the wire end portion 24 and the end tab 73 so that they are in an intimate touching connection to provide a good electrical connection.

Also, the sleeve 80 is held frictionally in place in the assembly 78. In other words, the resiliency of the wire end portion 24 urging the wire end portion 24 laterally outwardly away from the end tab 73 serves to hold the rivet 76 and assembly 78 in place.

Figure 6:
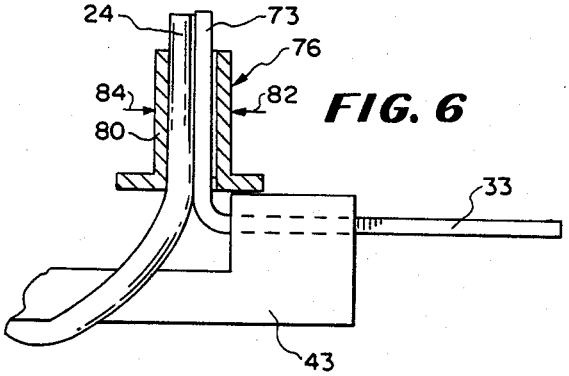
FIG. 6 is a vertical elevational view of the assembly shown in FIG. 5 with a portion of the retaining sleeve broken away.
Figure 8:
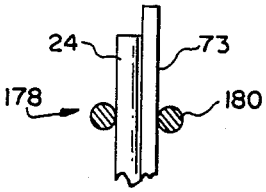
FIG. 8 is a vertical elevational view similar to FIG. 6 and shows a toroidal retaining ring in place of a retaining sleeve.

However, sometimes there may be a loose fit as shown in FIG. 6. In such a case, even though the resiliency of the wire end portion 24 holds the assembly 78 intact, it may be desirable to crimp the sleeve 80 as shown at 82 and 84 in FIG. 6 to ensure a good electrical contact between end tab 78 and wire end portion 24.

It should be remembered though that even with a loose fit, there usually is contact between the wire end portion 24 and the end tab 73, directly, through the metal sleeve 80, and through the solder 86 (FIG. 7) in and around the assembly 78.

After a rivet 76 has been placed over the wire end portion 24 and end tab 73, and likewise on the other end tabs of the male connectors 31–36, the multi-coil assembly 10 is inverted and dipped in a solder bath and then removed to allow the solder to cool and harden to form the solder joints 51–56.

It is to be noted that the wire end portions 21–30 are coated with an insulation which will burn off when dipped into the solder bath as a result of which the end portions 21–30 do not have to be scraped bare of insulation.

Figure 7:
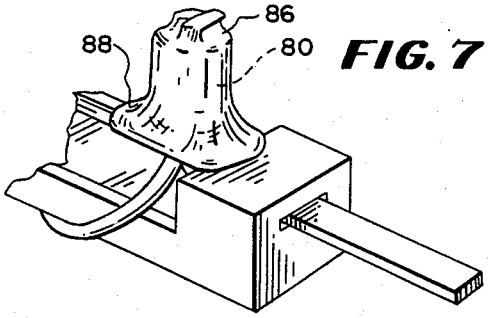
FIG. 7 is a perspective view of the assembly shown in FIGS. 5 and 6 after it had been dipped in a solder bath and the solder has cooled and hardened.

The resulting solder joint 53 is shown in FIG. 7 where the solder 86 extends around and into the sleeve 80.

The metal eyelets or rivets 76 each have a base flange 88 which can serve as a stop or limiting mark when inserting the assembly 78 formed on each end tab such as tab 73 into a solder bath. Alternatively, a simple sleeve without the flange 88 can be used.

Further in a modified embodiment of an assembly 178 a toroidal ring 180 can be inserted over wire end portion 24 and end tab 73 in place of tubular metal eyelet or rivet 76. In this embodiment the toroidal ring 180 can be a split ring to facilitate and enable squeezing of the ring 180 against the wire end portion 24 and end tab 73 to ensure a good electrical connection therebetween prior to soldering.

Additionally it will be apparent from FIG. 1 that some of the solder joints 51–56, e.g., solder joint 52, have two wire end portions 22 and 23 received within a ring of encircling material, such as a rivet 76. Thus the method of the present invention described above can be utilized in making a solder joint comprising more than one wire end portion soldered to an end tab of a male connector. Also, of course, the connector can be a female as well as a male connector.

It will be apparent from the foregoing description that the method for making a solder joint and the solder joint made thereby have a number of advantages, some of which have been described above and others of which are inherent in the invention. More specifically the method ensures holding of the wire end portion(s) adjacent or against an end tab, minimizes if not altogether prevents distortion of the support arm and connector, ensures a desired electrical and mechanical spacing between adjacent solder joints and eliminates solder bridging between adjacent solder joints.

Moreover, it will be apparent to one skilled in the art that modifications can be made to the method for making a solder joint and the solder joint formed thereby of the present invention without departing from the teachings of the invention. Accordingly the scope of the invention is only to be limited as necessitated by the accompanying claims.

I claim:

1. A method for forming a solder joint between a wire end portion of a coil mounted on a hub and an end tab of a male or female connector that can be mounted on a support fixed to the hub, said method including the steps of: placing at least one wire end portion adjacent an end tab; placing an encircling ring of material about the end tab and the at least one wire end portion, said ring of encircling material being sized to fit snugly about the end tab and the at least one wire end portion so that they are juxtaposed to each other and so that the resiliency of the at least one wire end portion urging it away from the end tab is sufficient to frictionally hold the ring of encircling material around the end tab and the at least one wire end portion; inverting and dipping the assembly of the end tab, the at least one wire end portion and the ring of encircling material into a solder bath; and removing the assembly from the solder bath and allowing it to cool and harden.

2. The method of claim 1 including the step of squeezing or crimping the ring of encircling material against the end tab and the at least one wire end portion prior to the dipping thereof into the solder bath.

3. The method of claim 1 wherein said ring of encircling material is a toroidal ring of small cross section.

4. The method of claim 3 wherein said toroidal ring is split to facilitate squeezing thereof.

5. The method of claim 1 wherein said ring of encircling material is a sleeve.

6. The method of claim 1 wherein said encircling ring is a tubular metal eyelet.

7. The method of claim 1 wherein said support mounts a plurality of end tabs of connectors which are parallel spaced from one another on said support, each end tab having at least one wire end portion held thereto by a ring of encircling material, and wherein all the assemblies of end tabs, wire end portions, and rings of encircling material are dipped simultaneously in a solder bath and removed therefrom without bridging of solder between the assemblies.

8. The method of claim 1 wherein said wire end portion initially has insulation all the way to the end of said wire end portion and said method includes the step of removing the insulation from said wire end portion by the hot solder in the soldering process.

9. Solder joint assemblies in a coil and hub assembly including a hub, a coil mounted on said hub and having wire end portions extending therefrom, a support mounted to and extending from said hub, and a plurality of connectors having end tabs mounted on said support, each solder joint assembly being formed between a corresponding wire end portion and a corresponding end tab of a male of female connector mounted on said support, and each solder joint assembly comprising one wire end portion having insulation all the way to the soldered end of said wire and portion being juxtaposed to one connector end tab, having a ring of encircling material holding them together, and having a mound of solder surrounding the assembly of the one end portion, the one end tab and said ring of encircling material, said solder also being received within the interstices between the parts of the assembly and being adhered to the parts of the assembly, and no solder bridging the gaps between adjacent solder joint assemblies after the end tabs of said coil and hub assembly have been dipped into a solder bath and then removed therefrom.

10. The solder joint assembly of claim 9 wherein said ring of encircling material is squeezed tight or crimped against the at least one wire end portion and the end tab.

11. The solder joint assembly of claim 9 wherein said ring of encircling material is a toroidal ring of small cross section.

12. The solder joint assembly of claim 11 wherein said toroidal ring is split to facilitate squeezing thereof.

13. The solder joint assembly of claim 9 wherein said ring of encircling material is a sleeve.

14. The solder joint assembly of claim 9 wherein said ring of encircling material is an unpunched rivet.

15. A plurality of solder joint assemblies including end tabs, wire conductor end portions, rings of encircling material and solder in a coil assembly including a coil mounted on a hub, a support on said hub, a plurality of end tabs of male or female connectors mounted on said support and being parallel spaced from one another on said support, each end tab having at least one wire end portion held thereto by one ring of encircling material, each solder joint assembly including at least one of said wire end portions and an associated one of said end tabs encircled by one ring of encircling material with solder about this assembly and in the interstices thereof, said solder joint assemblies being made by the method including the steps of: placing at least one of said wire end portions adjacent each one of said end tabs, placing one of said encircling rings of material about each end tab and the associated at least one wire end portion adjacent thereto, each ring of encircling material being sized to fit snugly about the end tab and the associated at least one wire end portion so that they are juxtaposed to each other and so that the resiliency of the at least one wire end portion urging it away from the end tab is sufficient to frictionally hold each ring of encircling material around each pair of end tab and associated at least one wire end portion; inverting and simultaneously dipping all the assemblies of end tabs, wire end portions and rings of encircling material into a solder bath; removing the assemblies from the solder bath without bridging of solder between the assemblies; and allowing the assemblies to cool and harden.

16. A solder joint assembly between at least one wire end portion of a coil mounted on a hub, and one end tab of a male or female connector mounted on a support fixed to the hub, the solder joint assembly including a ring of encircling material about the end tab and the at least one wire end portion and solder about the assembly of the at least one wire end portion, the end tab and the ring of encircling material and in the interstices between the parts of this assembly, and said solder joint assembly being made by the method including the steps of: placing the at least one wire end portion adjacent the end tab; placing an encircling ring of material about the end tab and the at least one wire end portion, said ring of encircling material being sized to fit snugly about the end tab and the at least one wire end portion so that they are juxtaposed to each other and so that the resiliency of the at least one wire end portion urging it away from the end tab is sufficient to frictionally hold the ring of encircling material around the end tab and the at least one wire end portion; inverting and dipping the assembly of the end tab, the at least one wire end portion and the ring of encircling material into a solder bath; removing the assembly from the solder bath; and allowing the assembly to cool and harden.

* * * * *

UNITED STATES PATENT AND TRADEMARK OFFICE

CERTIFICATE OF CORRECTION

PATENT NO. : 4,530,563

DATED : July 23, 1985

INVENTOR(S) : Dorothy S. Brzezinski

It is certified that error appears in the above-identified patent and that said Letters Patent is hereby corrected as shown below:

Column 6, line 10, "of", second occurrence, should be --or--;

line 13, "and" should be --end--;

lines 34-35 should be:

--14. The solder joint assembly of claim 9 wherein said encircling ring is a tubular metal eyelet.--

Signed and Sealed this

Sixteenth Day of December, 1986

*Attest:*

DONALD J. QUIGG

*Attesting Officer* *Commissioner of Patents and Trademarks*